United States Patent [19]

Hockaday

[11] Patent Number: 4,844,128

[45] Date of Patent: Jul. 4, 1989

[54] INHANCED OUTPUT OPTO-FLUIDIC DEVICE

[75] Inventor: Bruce D. Hockaday, Vernon, Conn.

[73] Assignee: United Technologies Corporation, Hartford, Conn.

[21] Appl. No.: 289,867

[22] Filed: Dec. 27, 1988

[51] Int. Cl.[4] ..... F15C 1/04

[52] U.S. Cl. ..... 137/828; 137/833; 137/835; 137/840

[58] Field of Search ..... 137/821, 828, 840, 833, 137/835, 804; 250/351, 353

[56] References Cited

U.S. PATENT DOCUMENTS

| | | | |
|---|---|---|---|
| 3,228,411 | 1/1966 | Straub | 137/827 |
| 3,591,809 | 7/1971 | Laakaniemi | 137/827 |
| 3,721,257 | 3/1973 | De Santis et al. | 137/828 |
| 4,512,371 | 4/1985 | Drzewiecki et al. | 137/828 |
| 4,606,375 | 8/1986 | Hockaday | 137/828 |
| 4,610,274 | 9/1986 | Glomb, Jr. et al. | 137/828 |
| 4,689,827 | 8/1987 | Gurney, Jr. | 137/828 |

*Primary Examiner*—A. Michael Chambers

*Attorney, Agent, or Firm*—Peter R. Ruzek

[57] ABSTRACT

An enhanced output opto-fluidic device includes three plates which together bound a number of passages including an interaction passage, an inlet channel including which opens into one of such ends, and two outlet channels which open into the other end of the interaction passage at symmetrically arranged outlet regions. Fluid is caused to flow through the inlet channel into the interaction passage to form a jet stream that flows toward the outlet regions. After the flow of the fluid through the inlet channel has been intentionally disturbed by heating a transversely offset light-absorbing zone of the inlet channel by a light beam with attendant heating of the fluid flowing past such zone and initial transverse deflection of the jet stream, the extent of such deflection is enhanced by supplying additional amounts of the fluid to symmetrically situated lateral locations of the interaction passage so that the jet stream permits more of the fluid to enter the interaction passage from that of the locations from which it deflected away than from the other locations with attendant additional deflection of the jet stream.

8 Claims, 2 Drawing Sheets

INHANCED OUTPUT OPTO-FLUIDIC DEVICE

TECHNICAL FIELD

The present invention relates to actuating devices in general, and more particularly to devices which convert optical signals into fluid pressure or flow signals.

BACKGROUND ART

There are already known various constructions of devices capable of transforming various external parameters by altering the flow of a fluid through the device. One device of this type is disclosed in the commonly owned U. S. Pat. No. 4,610,274 where the external parameter is the intensity of laser light that is directed into one of two inlet channels arranged upstream of an input nozzle to heat a light-absorbing zone which, in turn, warms up the fluid flowing past such zone and thus influences the flow of the fluid downstream of this zone into, through and beyond the nozzle and then as a jet stream emerging from the nozzle into a vented interaction passage substantially in the longitudinal direction of the interaction passage to one or both of two outlets. In this device, the heat imparted to the fluid at the light-absorbing zone reduces the thickness of the boundary layer at the adjacent wall bounding the respective inlet channel and this ultimately results in a deflection of the jet stream transversely of the interaction passage so that the fluid enters one of the outlet channels in an amount and/or at a pressure exceeding that or those applicable to the other outlet channel. Then, the magnitude of the optical signal determines the difference between the flow or pressure conditions in the two outlet channels.

While this opto-fluidic device operates to satisfaction in many applications, experience has shown that at least in some instances the difference between the monitored conditions in the two outlet channels is too small to give adequate power to actuate hydromechanical devices.

Accordingly, it is a general object of the present invention to avoid the disadvantages of the prior art.

More particularly, it is an object of the present invention to provide an opto-fluidic device which does not possess the disadvantages of the known device of this kind.

Still another object of the present invention is to develop the opto-fluidic device of the type here under consideration in such a manner as to enhance the differential between its output values for the same value of the optical input signal.

It is yet another object of the present invention to devise an opto-fluidic device of the above type which has an improved power conversion efficiency as compared to prior art devices of this type.

A concomitant object of the present invention is design the opto-fluidic device of the above type in such a manner as to be relatively simple in construction, inexpensive to manufacture, easy to use, and yet reliable in operation.

DISCLOSURE OF THE INVENTION

In keeping with these objects and others which will become apparent hereafter, one feature of the present invention resides in an enhanced output opto-fluidic device which comprises means for bounding at least an interaction passage which extends along a central plane including a central axis and has two axially spaced ends, an inlet channel including a nozzle orifice which opens along the central axis into one of the ends of the interaction passage, and two outlet channels which open into the other end of the interaction passage at respective outlet regions that are situated symmetrically with respect to the central axis. This device further includes means for causing a fluid to flow in a streamlined manner through the inlet channel into the interaction passage to form, after its emergence from the nozzle orifice, a jet stream that flows axially of the interaction passage toward the outlet regions with the flowing fluid being equally distributed between the outlet channels in the absence of disturbance of the flow through the nozzle orifice and the interaction passage by external influences. There is further provided means for disturbing the flow of the fluid through the inlet channel, such flow-disturbing means including light-absorbing means including at least a zone situated in the inlet channel at a transverse offset from the central axis, and means for directing a light beam through the bounding means against the zone to convert the energy of the light beam into thermal energy that locally heats the fluid flowing past the zone with attendant transverse deflection of the jet stream in one transverse direction along the central plane. According to the invention, the device also includes means for enhancing the extent of the deflection, such enhancing means including means for supplying the fluid at equal pressure to locations of the interaction passage that are arranged downstream of the nozzle orifice symmetrically with respect to the central axis for the jets stream to permit more of the fluid to enter the interaction passage from that of the locations from which the jet stream is deflected away than from the other of the locations with attendant additional deflection of the jet stream in the one transverse direction.

BRIEF DESCRIPTION OF THE DRAWINGS

The present invention will be described in more detail below with reference to the accompanying drawing in which.

BEST MODE FOR CARRYING OUT THE INVENTION

Figure 1:
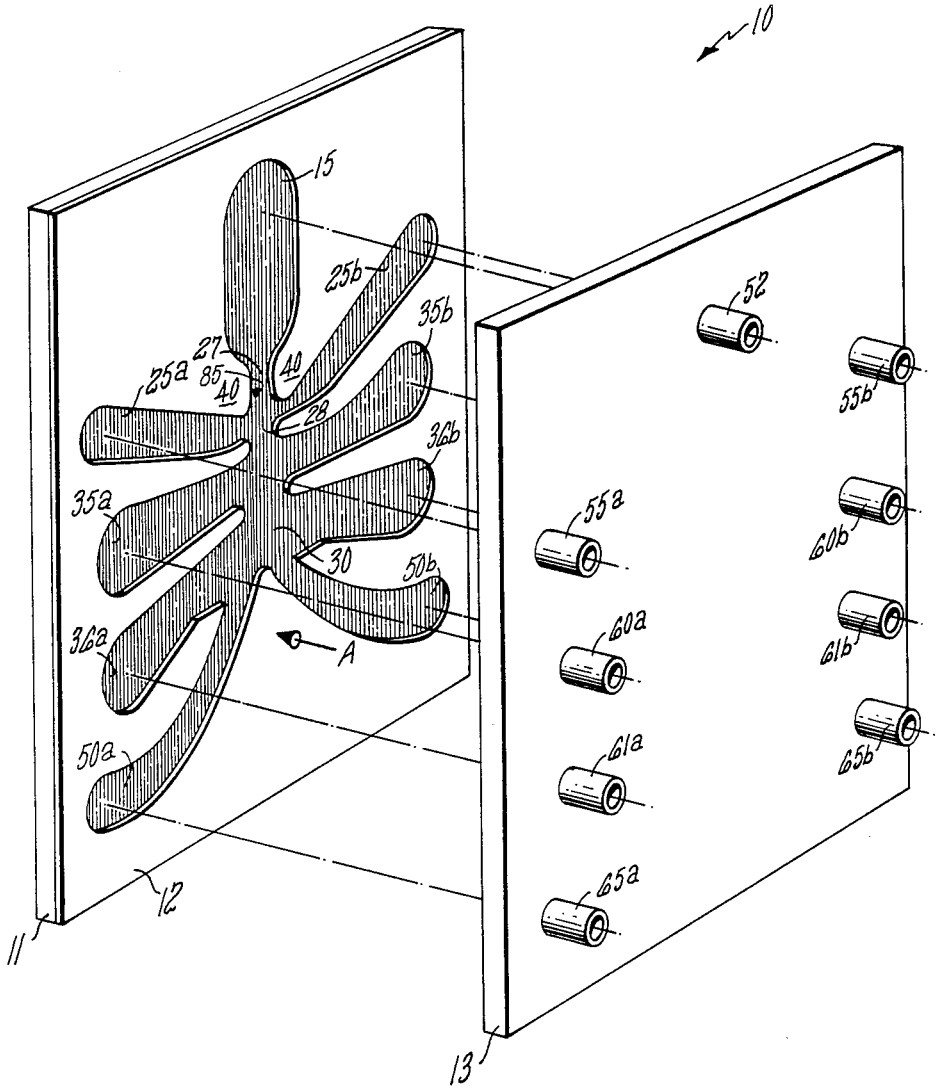
FIG. 1 is an exploded perspective view of an opto-fluidic device of the present invention.

Referring now to the drawing in detail, and first to FIG. 1 thereof, it may be seen that the reference numeral 10 has been used therein to identify an opto-fluidic device of the present invention in its entirety. The device 10 comprises a laminar arrangement of plates 11, 12, and 13. The plate 11 is formed from, or coated on an interior surface thereof with, an optically absorbent material such as a graphite-epoxy composite 20 which incorporates graphite reinforcement fibers that are disposed generally in parallel orientation to the fluid flow through the device 10.

Figure 2:
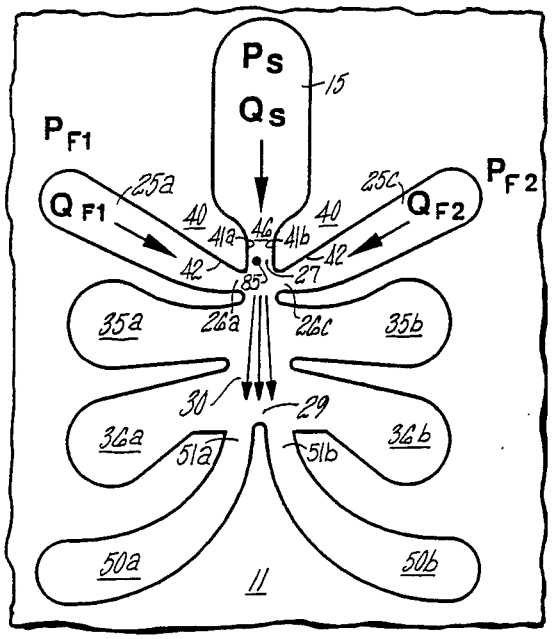
FIG. 2 is an enlarged top plan view taken in the direction of an arrow A of central and bottom plates of the device of FIG. 1 illustrating not only the relative locations of various passages in the central plate but also the flow of fluid therethrough during the use of the device.

As illustrated especially in FIG. 2 of the drawing, the plate 12 has a network of flow passages or channels provided therein either by machining, etching stamping or equivalent techniques. Such passages and channels include a single input channel 15 which leads to a supply nozzle orifice 27 to feed a fluid, while the device 10 is in operation, to an open area (interaction passage) 30 situated between four generally symmetrically arranged vent channels 35*a*, 35*b*, 36*a* and 36*b*. The nozzle orifice 27 may be slightly divergent at least at its downstream end which opens into an upstream end portion 28 of the interaction passage 30 that is somewhat wider than the nozzle orifice 27 but narrower than the downstream remainder of the interaction space 30. Furthermore, respective feedback nozzles 26*a* and 26*b* of two feedback channels 25*a* and 25*b* open substantially symmetrically into the upstream end portion 28 of the interaction passage 30 from opposite sides thereof.

As also illustrated particularly in FIG. 2, the feedback channels 25*a* and 25*b* inclusive of the feedback nozzles 26*a* and 26*b* are generally convergent, being separated from the inlet channel 15 by portions of the plate 12 that constitute respective flow separators 40. Each separator 40 comprises a pair of convergent sidewall regions 41 (which together laterally delimit the nozzle orifice 27) and two additional sidewall regions 42 (each of which partially laterally bounds the feedback nozzle 26*a* or 26*b* of one of the feedback channels 25*a* or 25*b*). The associated ones of the sidewall regions 41 and 42 are joined with one another at respective relatively blunt noses 44.

As a comparison with FIG. 1 of the drawing will reveal, all of such areas of the separators 40 are in upstanding relationship to a bottom wall 46 of the nozzle orifice 27 which is formed by the optically absorbent composite. Respective upstream regions 51*a* and 51*b* of two outlet channels 50*a* and 50*b*, which are also provided in the plate 12 by one of the aforementioned manufacturing processes, communicate with a downstream end portion 29 of the interaction passage 30. The plate 13 is drilled and provided with a plurality of taps (ports) for making fluid connections to the various channels provided in the plate 12. Thus, an inlet port 52 connects the inlet channel 15 with a suitable source of pressurized fluid (not shown), respective feedback ports 55*a* and 55*b* may connect the feedback channels 25*a* ad 25*b* with a pressurized fluid source (which may be the same as that mentioned above) or the port 55*a* may be connected only to the port 55*b*, while respective venting ports 60*a*, 61*a*, 60*b* and 61*b* communicate with the vent passages 35*a*, 36*a*, 35*b* and 36*b*. Respective outlet ports 65*a* and 65*b* communicate with the outlet passages 50*a* and 50*b*.

The fluid handling portion of the opto-fluidic device 10 described hereinabove functions as a fluidic signal converter. Thus, it will be seen that fluid introduced to the inlet channel 15 through the inlet port 52 flows through the nozzle orifice 27, through the interaction passage 30 between the vent passages 35*a* and 36*a*, on the one hand, and 35*b* and 36*b*, on the other hand, and is split between the output channels 50*a* and 50*b*. Maintenance of a constant pressure within the interaction region 30 is effected by selectively venting the interaction region 30 at the channels 35*a*, 35*b*, 36*a* and 36*b* through the venting ports 60*a*, 60*b*, 61*a* and 61*b*, respectively. Fluidic signal generation is achieved by controlling the flow conditions through the nozzle orifice 27 in such a manner as to turn some of the flow through the device toward one or the other of the outlet channels 50*a* and 50*b* to achieve a desired difference in pressure therebetween. Similarly, the device 10 may function as a switch wherein the entire flow is diverted from one of the outlet channels 50*a* and 50*b* to the other.

While in most of the prior art fluidic amplifiers or switches such input signals are fluidically applied through control ports, in the device 10 of the present invention, like in that of the aforementioned patent, the input signal comprises an optical signal applied directly to an eccentric light-absorbent zone of the nozzle orifice bottom wall 46 and/or the adjacent one of the sidewall regions 41*a* or 41*b*. The optical input signal to the opto-fluidic device 10 comprises a focused optical signal applied to a discrete location on the optically absorbent composite. The means for applying this signal (not shown) typically comprises a source of light such as a laser, a light emitting diode or any other suitable light source, and an optical conducting system, such as one including an optical fiber and a collecting lens system. As indicated in FIG. 2 of the drawing, optical energy from the laser or other light source is focused by the lens system onto a point 85 on the optically absorbent composite. This focused optical energy heats an area of the inlet nozzle orifice wall structure adjacent the point 85 including the adjacent area of the sidewall region 41*a*. The orientation of the graphite fibers, which is generally parallel to the direction of flow, minimizes the conduction of heat through the composite away from the sidewall region 41*a*. The effect of the sidewall region heat is lowering of the viscosity of the fluid flowing past the heated area of the sidewall region 41*a*. Lowering the fluid viscosity in this manner reduces the thickness of the flow boundary layer at the heated wall area, thereby enhancing the degree to which the flow remains attached to the sidewall region 41.

Figure 3:
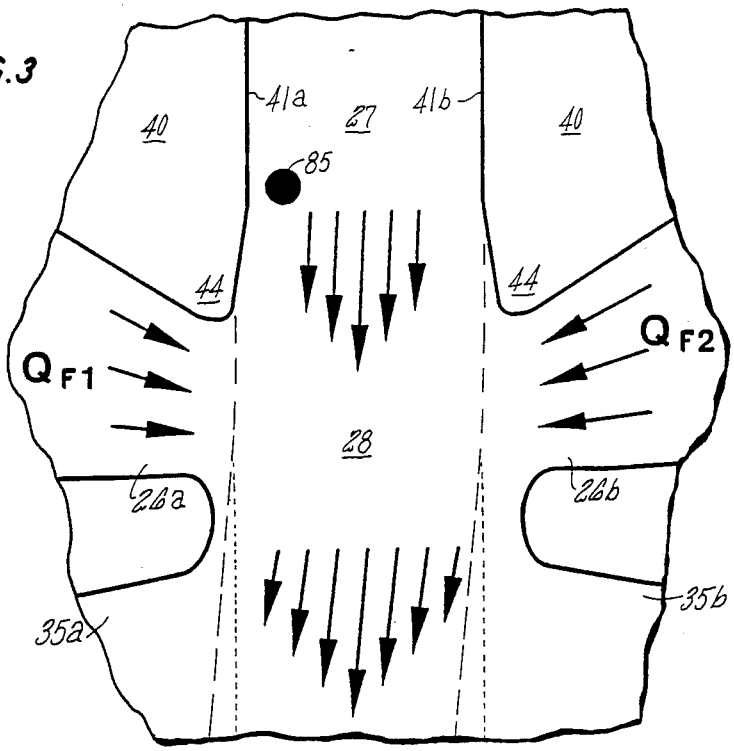
FIG. 3 is a view similar to that of FIG. 2 but at a still enlarged scale and showing only a fragment of the central plate and the flow of the fluid through the various passages thereof during the use of the device of FIG. 1.

As illustrated in FIG. 3, increasing the span of the left-hand nozzle orifice sidewall region 41*a* to which the flow is attached effects deflection of the jet stream that emerges from the nozzle orifice 27 into the upstream end portion 28 of the interaction passage 30 and then into the remainder of the interaction passage 30 to the left, thereby establishing an initial imbalance in flow conditions between the outlet channels 51*a* and 51*b* (shown only in FIGS. 1 and 2), and defining a fluidic pressure difference output signal therebetween. Similarly, increasing the span of the right-hand sidewall 41*b* bounding the nozzle orifice 27 to which the flow remains attached by moving the point 85 transversely of the nozzle orifice 27 toward the sidewall 41*b* effects deflection of the flow within the interaction passage 30 to the right to establish a fluid pressure difference output signal of opposite magnitude between the outlet channels 60*a* and 60*b* and and thus between the outlet ports 65*a* and 65*b*. These initial flow conditions, which are indicated in FIG. 3 of the drawing by dotted lines representative of the approximate boundaries of the thus initial optically deflected jet stream, are basically the same as those encountered in the opto-fluidic device of the aforementioned patent.

Now, as the initial optically deflected jet stream flows through the upstream end portion 28 of the interaction passage 30, it passes by the feedback nozzles 26*a* and 26*b* that are arranged symmetrically at opposite sides of the jet stream. It may be ascertained from FIG. 3 that the initial optically deflected jet stream flows closer to the feedback nozzle 26*a* than to the feedback nozzle 26*b*. This, in turn, means that the jet stream constitutes less of a hindrance to the entry of additional fluid from the feedback nozzle 26*b* than from the feedback nozzle 26*b*. Consequently, when the pressure of the additional fluid supplied into each of the feedback channels 25*a* and 25*b* is the same, as contemplated, a quantity $Q_{f1}$ of the additional fluid (which may be close to or at zero) enters the upstream end portion 28 of the interaction passage 30 from the feedback nozzle 26*a* while, at the same time, a much larger quantity $Q_{f2}$ of the additional fluid enters the upstream end portion 28 from the feedback nozzle 26*b*. While most if not all of this additional fluid will be vented through the vent channels 35*a* and 35*b* (and/or the vent channels 36*a* and 36*b* omitted from FIG. 3), this additional fluid entry imbalance would have already had its desired impact on the path of flow of the jet stream through the remainder of the interaction passage 30 before then by imparting the imbalance in the kinetic energy of the additional fluid entering the upstream end portion 28 from the feedback nozzles 26*a* and 26*b* to the jet stream, thus diverting the jet stream even more to the left in the situation depicted in FIG. 3, as indicated by dashed lines representative of the approximate boundaries of the thus fluidically additionally diverted jet stream. This, of course, means that the initial imbalance between the amounts of fluid reaching the outlet ports 51*a* and 51*b*, and thus, in the final analysis, the magnitude of the difference output signal, will be further enhanced or augmented, which improves the response or sensitivity of the device 10 to the optical signals directed against the point 85. It will be appreciated that, if the point 85 is located at the sidewall region 41*b*, the flow conditions will be akin to those described above but with the jets stream being deflected first optically and then additionally fluidically to the right rather than to the left, with attendant change in the sign of the difference output signal.

It will thus be apparent that the opto-fluidic device of the present invention provides an uncomplicated yet effective and reliable control device for converting an optical input signal to an enhanced fluidic output signal. By the application of focused optical energy to a discrete location 85 of an optically absorbent portion situated at one of two divergent inlet nozzle sidewall regions 41*a* and 41*b*, the flow conditions in the device 10 and therefore the imbalances between the output ports 65*a* and 65*b* can be controlled in an enhanced fashion. With appropriate sizing of the various passages and optical input signal strength, a predetermined output (a predetermined pressure difference between the output ports 65*a* and 65*b*) is reliably attained with accuracy and repeatability. Such accuracy and repeatability are further enhanced by the inherent insensitivity of the device to optical signal position along the sidewall region 41*a* or 41*b*.

It has been observed that the device 10 of the present invention would be extremely sensitive to optical input signal position if the optical input signal were applied at the respective nose 44. That is, even a slight deviation in the optical signal position would result in a significant change in the output signal magnitude. However, the application of the optical input signal upstream from the respective nose 40 results in an output signal relatively immune to minor discrepancies in input signal location along the respective sidewall region 41*a* or 41*b*, whereby the manufacturability of the device is improved.

Those skilled in the art will readily appreciate the innumerable applications for the present invention. For example, in "fly by light" aircraft control systems, optical input signals can be applied to opto-fluidic devices such as that of the present invention and the output pressure difference of the device can be applied to such apparatus as hydraulic actuators to set the position of aircraft control surfaces and the like. It will also be noted that the opto-fluidic device of the present invention is readily adaptable for use with similar fluidic devices such as known fluidic amplifiers for further amplification of the output signal across the outlet ports 65*a* and 65*b*. In such an arrangement, the output signal across the outlet ports 65*a* and 65*b* would be fed as an input signal to a second, state-of-the art fluidic amplifier. With such an arrangement, fluidic input signals (output signals from the outlet ports 65*a* and 65*b*) applied to a pressurized supply flow would result in amplification of such fluidic input signals at the output of the second amplifier. Further amplification (and if necessary, further control by way of fluidic control signals input to the amplifier control passages) would therefore be readily achieved by further cascading of the output signals with further stages of fluidic amplification.

While a particular embodiment of the device 10 of the present invention has been shown and described, it will be appreciated that the disclosure herein will suggest various alternate embodiments to those skilled in the art. Thus, while in the description herein, the optical input signal is applied to one side of the inlet nozzle orifice 27, it will be readily appreciated that an opposite output pressure signal may be achieved by directing the optical input signal to the other side of the inlet nozzle orifice 27. Furthermore, while the optically absorbent material has been described as a graphite epoxy composite, various other compositions such as carbon impregnated ceramic will also suggest themselves to those skilled in the art. Also, the optical input signal may be applied either to the back of the plate 11 or, if the plate 13 is transparent, to the front of the plate 11. Similarly, various other arrangements of fluidic passages adaptable to fluidic control by boundary layer reduction resulting from the application of an optical input signal to a single optically absorbent inlet nozzle orifice 27, such as those using two inlet channels 15 instead of one, may also readily suggest themselves to those skilled in the art. Therefore, it is intended by the following claims to cover any such alternate embodiments as fall within the true spirit and scope of this invention.

I claim:

1. An enhanced output opto-fluidic device, comprising means for bounding at least an interaction passage which extends along a central plane including a central axis and has two axially spaced ends, an inlet channel including a nozzle orifice which opens along said central axis into one of said ends of said interaction passage, and two outlet channels which open into the other of said ends of said interaction passage at respective outlet regions that are situated symmetrically with respect to said central axis;

means for causing a fluid to flow in a streamlined manner through said inlet channel into said interaction passage to form after its emergence from said nozzle orifice a jet stream that flows axially of said interaction passage toward said outlet regions with the flowing fluid being equally distributed between said outlet channels in the absence of disturbance of the flow through said nozzle orifice and said interaction passage by external influences;

means for disturbing the flow of the fluid through said inlet channel, including light-absorbing means including at least a zone situated in said inlet channel at a transverse offset from said central axis, and means for directing a light beam through said bounding means against said zone to convert the energy of said light beam into thermal energy that locally heats the fluid flowing past said zone with attendant transverse deflection of said jet stream in one transverse direction along said central plane; and means for enhancing the extent of said deflection, including means for supplying the fluid at equal pressure to locations of said interaction passage that are arranged downstream of said nozzle orifice symmetrically with respect to said central axis for the jets stream to permit more of the fluid to enter said interaction passage from that of said locations from which the jet stream is deflected away than from the other of said locations with attendant additional deflection of the jet stream in said one transverse direction.

2. The opto-fluidic device as defined in claim 1, wherein said bounding means further bounds at least two venting channels which open into said interaction passage symmetrically with respect of said central axis downstream from said enhancing means.

3. The opto-fluidic device as defined in claim 1, wherein said zone is situated in said nozzle orifice.

4. The opto-fluidic device as defined in claim 1, wherein said inlet channel extends along an extension of said central axis and terminates in said nozzle orifice at its downstream end.

5. An opto-fluidic device, comprising means for bounding at least an interaction passage which extends along a central plane including a central axis and has two axially spaced ends, a single inlet channel extending along said central axis and including a nozzle orifice which opens along said central axis into one of said ends of said interaction passage, and two outlet channels which open into the other of said ends of said interaction passage at respective outlet regions that are situated symmetrically with respect to said central axis;

means for causing a fluid to flow in a streamlined manner through said inlet channel into said interaction passage to form after its emergence from said nozzle orifice a jet stream that flows axially of said interaction passage toward said outlet regions with the flowing fluid being equally distributed between said outlet channels in the absence of disturbance of the flow through said nozzle orifice and said interaction passage by external influences; and means for disturbing the flow of the fluid through said inlet channel, including light-absorbing means including at least a zone situated in said nozzle orifice at a transverse offset from said central axis extension, and means for directing a light beam through said bounding means against said zone to convert the energy of said light beam into thermal energy that locally heats the fluid flowing past said zone with attendant transverse deflection of said jet stream in one transverse direction along said central plane.

6. The opto-fluidic device as defined in claim 5, wherein said bounding means further bounds at least two venting channels which open into said interaction passage symmetrically with respect of said central axis.

7. The opto-fluidic device as defined in claim 5, and further comprising means for enhancing the extent of said deflection, including means for supplying the fluid at equal pressure to locations of said interaction passage that are arranged downstream of said nozzle orifice symmetrically with respect to said central axis for the jets stream to permit more of the fluid to enter said interaction passage from that of said locations from which the jet stream is deflected away than from the other of said locations with attendant additional deflection of the jet stream in said one transverse direction.

8. The opto-fluidic device as defined in claim 7, wherein said bounding means further bounds at least two venting channels which open into said interaction passage symmetrically with respect of said central axis downstream from said enhancing means.

* * * * *